US006796925B2

(12) United States Patent
Martinez et al.

(10) Patent No.: US 6,796,925 B2
(45) Date of Patent: Sep. 28, 2004

(54) EXERCISE REPETITIOUS MOTION COUNTER

(76) Inventors: Martha Z. Martinez, 710 Taylor Blair Rd., West Jefferson, OH (US) 43162; Kathryn Susan Eaton, 710 Taylor Blair Rd., West Jefferson, OH (US) 43162

( * ) Notice: Subject to any disclaimer, the term of this patent is extended or adjusted under 35 U.S.C. 154(b) by 297 days.

(21) Appl. No.: 10/077,748

(22) Filed: Feb. 20, 2002

(65) Prior Publication Data

US 2002/0132703 A1 Sep. 19, 2002

Related U.S. Application Data

(60) Provisional application No. 60/276,039, filed on Mar. 16, 2001.

(51) Int. Cl.[7] ..... A63B 21/00

(52) U.S. Cl. ..... 482/8; 482/1; 482/9; 482/900; 482/4

(58) Field of Search ..... 482/1–9, 900–902

(56) References Cited

U.S. PATENT DOCUMENTS 4,175,446 A 11/1979 Crowninshield et al.
4,262,898 A 4/1981 Lee
4,337,938 A 7/1982 Rodriguez
4,525,074 A 6/1985 Murakami
4,571,680 A 2/1986 Wu
4,593,902 A 6/1986 Michaelsen
4,846,459 A 7/1989 Vivian
5,626,537 A 5/1997 Danyo et al.
5,897,457 A * 4/1999 Mackovjak ..... 482/8
6,358,188 B1 * 3/2002 Ben-Yehuda et al. ..... 482/8
6,669,600 B2 * 12/2003 Warner ..... 482/8

* cited by examiner

*Primary Examiner*—Glenn E. Richman
(74) *Attorney, Agent, or Firm*—Young & Thompson

(57) ABSTRACT

An exercise repetitious motion counter includes a case containing a repetition counter display mounted within the case and visible through a first opening of the case, a proximity sensor mounted within the case and extending through a second opening of the case, the proximity sensor connected to the display to cause the display to show a repetition count when a portion of an exerciser's body comes into non-contact proximity to the proximity sensor, and a detection distance setting mounted within the case and extending through a third opening of the case, the detection distance setting being connected to the proximity sensor and variable to determine a proximity sensitivity range of the proximity sensor.

20 Claims, 2 Drawing Sheets

EXERCISE REPETITIOUS MOTION COUNTER

CROSS-REFERENCE TO RELATED APPLICATIONS

This application claims benefit of earlier U.S. Provisional 60/276,039, filed Mar. 16, 2001.

BACKGROUND OF THE INVENTION

This invention relates to motion counters such as those used for counting repetitious motion while exercising. One embodiment of the invention, an exercise motion counter, uses a motion/proximity sensor or detector to keep track of an exerciser's repetitive movements or "REPS".

DESCRIPTION OF THE RELATED ART

The prior art includes motion counters that are relative complex and thus do not lend themselves for use by an exerciser in counting REPS.

In the past, exercise counters have primarily measured time as an exercise proxy, e.g., stop-watches. Stop-watches are suitable for exercisers who run for exercise and provide historic run-times that encouraged the runner to beat the previous run-time by running faster.

The prior art also includes pedometers. Pedometers are suitable for both runners and walkers who want to measure or count distances.

There also have been measurement instruments for strength, such as standard weight or resistance belts.

Each of these prior art devices, however, are unsuitable for use by people who exercised by repetitious motion other than using their feet in walking or running, e.g., by sit-ups and push-ups. In the past, when doing such repetitious motion exercises, someone had count (and remember) the REPS manually. Sometimes some other person such as a coach or instructor would count and keep track of REPS.

There have been some electronic devices that assist an exerciser with counting and keeping REPS counts for repetitious exercises such as sit-ups. These devices included foot restraints, pulling devices, and doors for positioning. Other devices would require straps that the person would have to wear or buttons that they would have to push, etc. However, these devices are clumsy and too complicated for easy use, and consequently exercisers find them undesirable for continued use.

Therefore, exercisers who need to keep track of their REPS have been at a loss, with no practical and easy device for measuring their exercise.

SUMMARY OF THE INVENTION

The present invention provides an exercise repetitious motion counter that overcomes many of the prior art problems described above. The present invention provides counters that are easy to use; are small, lightweight, and quiet; may be worn on the exerciser's body or may be placed on a stationary object or surface apart from the exerciser's body; do not require the exerciser pushing, pulling, or lifting a part of the counter; are fully digital and thereby avoid the use of springs, belts, etc.; do not require physical contact with the counter; and do not require to use of a foreign object, such as a door, for use.

The present invention provides an exercise repetitious motion counter using a motion/proximity sensor or detector that, when placed on or near the person exercising, tracks and keeps the person's REPS by the person's body moving into and out of non-contact proximity with the detector.

An object of the present invention is to provide a hands-free, no-contact device that, each time an exercise movement is made, the device senses or detects the exercise movement and counts, displays, and keeps the number of REPS without interaction by the exerciser during repetitious exercise. Thereby, the inventive device frees the exerciser to complete his or her workout without having to worry about holding, pushing or pulling any counting aid.

A further object of the invention is to provide a device that frees the exerciser from having have to count to himself or herself to keep track of the routine's REPS. Advantageously, while exercising, the exerciser can listen to the radio or watch television without worrying about counting or miscounting repetitions.

BRIEF DESCRIPTION OF THE DRAWINGS

An embodiment of the invention will now be described, with reference to the accompanying drawing figures.

DESCRIPTION OF THE PREFERRED EMBODIMENTS

In the figures, like elements are identified with like element numbers.

Figure 1:
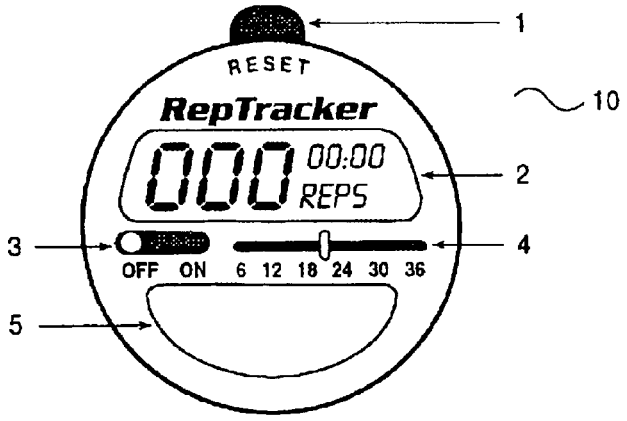
FIGS. 1–3 are front, side, and back views of one embodiment of the invention.
Figure 2:
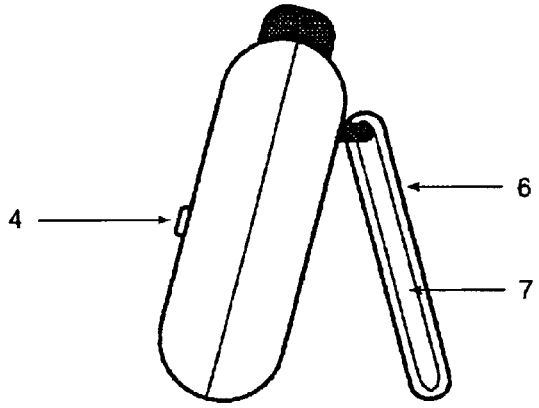
Figure 3:
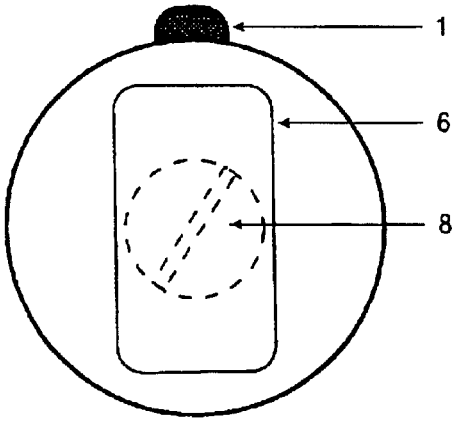

FIGS. 1–3 show an embodiment of the invention in the form of an exercise counter 10. In these figures, element 1 shows a reset button; element 2 is a device display, e.g., an LCD display showing a REPS number and elapsed time; element 3 is a power switch; element 4 is a detection distance setter; element 5 is a motion/proximity sensor or detector, with the drawing showing an exposed portion of the sensor; element 6 is an hinged device easel with slit 7; and element 8 is a battery compartment.

The counter 10 is advantageously built small, lightweight and easy to use. A hard shell case may be used in order to assure the counter 10 is able to withstand mishandling.

The front side (FIG. 1) of the counter 10 comprises a control panel including a power switch 3 operatively connected to the remaining electronic elements of the counter 10, an easy to read LCD display 2 (showing REPS count and time elapsed), detection distance setting 4, a motion or proximity sensor 5, and a reset button 1.

The reset button 1 is conventionally connected to the proximity sensor 5 and may be used to stop and restart the proximity sensor 5 for REPS counting. The reset button 1 may also be connected to clock circuitry providing a timer function. The sensor 5 and clock circuitry would be connected to display 2.

The detection distance setting 4 is set by the user, prior to commencing the exercise, to an approximate distance from the sensor 5 to a relevant part of the exerciser's body. That is, to a part of the exerciser's body that will serve as the reference for counting REPS. The detection distance setting 4 provides a detection range sensitivity for the sensor 5.

The sensor 5 includes an exposed portion as shown by FIG. 1, through which exposed portion the sensor emits a reflectable signal used to detect the exerciser's movement. The sensor 5 is connected to detection distance setting 4 and has a detection range based on the current setting of the detection distance setting 4. In some embodiments, a self-calibrating sensor obviates the need for detection distance setting 4.

The sensor 5 is a position sensitive sensor (detector) and may utilize infrared, ultrasonic, photoelectric or any other type of signal capable of detecting movement of the exerciser's body in a non-contact, proximity manner by the signal being reflected off the exerciser or a nearby object and then being detected on return to the sensor 5. Self-contained photoelectric sensors such as the PZ-V/M Series of Keyence Corporation of America are suitable. The sensor 5 is selected based on the proximity range for the repetitious motion that is to be counter.

As shown by FIG. 2, on the back side of the counter 10 there is an adjustable easel 6 for leaning the counter 10 in various angles when placed on a horizontal surface such as a floor.

The easel 6 is wide enough to provide stability to the counter 10. Optionally, there may be an opened vertical slit 7 on the easel 6 so that the exerciser can attach the counter 10 to a belt or a velcro™ (hook and eye) strap and wear the counter 10 on the exerciser's body. Alternatively, the counter 10 can be attached to some stationary object such as a vertical post.

The counter 10 is powered by a battery 8, e.g., a small rechargeable battery. Referring to FIG. 3, the battery may conveniently be housed with the main portion of the counter 10 hidden from view by the easel 6.

Figure 4:
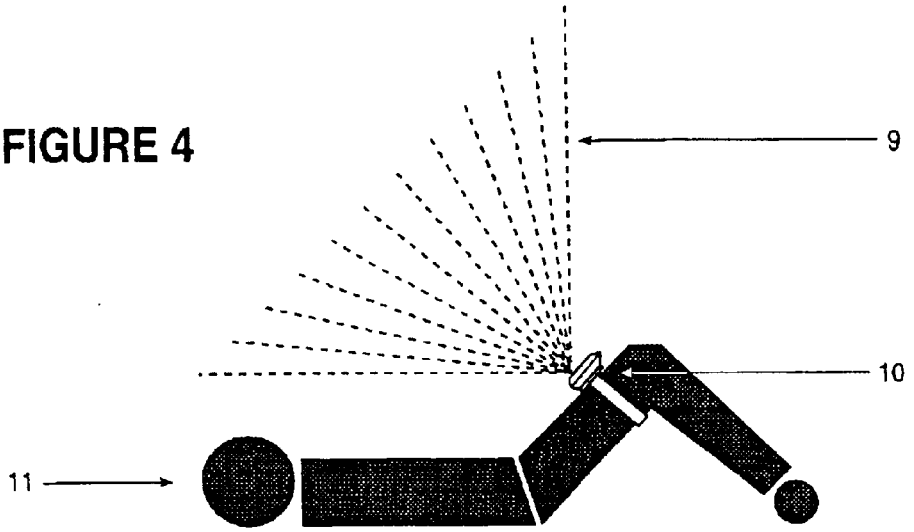
FIGS. 4–5 show the invention as user by an exerciser doing sit-ups.
Figure 5:
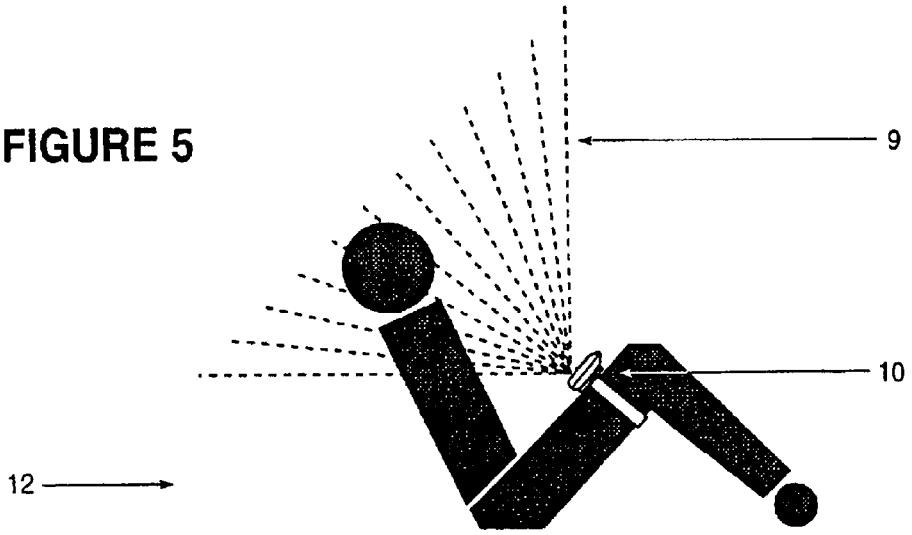

FIGS. 4–5 show the counter 10 in use.

FIG. 4 shows the exerciser in a first position 11 to start a sit-up. In this figure, the counter 10 is placed with a strap near the knee of the exerciser. The counter 10 may be placed at other locations on the exerciser's body or some other place apart from the exerciser, depending on the kind of exercise being performed.

When the counter 10 is powered on, the sensor 5 sends out a signal that will capture a certain angle detection range 9, i.e., a certain amount of distance and angle. If the counter 10 includes a detection distance setting 4, the user sets the angle detection range with detection distance setting 4 based on the proximity point at which the sensor should detect the exerciser's body and count a REPS.

In this startup first position 11 of FIG. 4, the sensor 5 will not detect any motion from the exerciser because he or she is not within the angled detection range 9 of the sensor 5. Therefore the display 2 will not show any counting activity.

FIG. 5 shows the exerciser starting the exercise routine in a sit-up second position 12. In this sit-up second position 12 the sensor 5 will detect motion from the exerciser because he or she is within the angled detection range 9 of the sensor 5. At this point, the display 2 of the counter 10 will show a first REPS count. Every time the exerciser moves from the first position 11 to the second position 12 to complete a sit-up during the routine, the sensor 5 will detect a REPS and show a further count on the display 2.

The counter 10 will continue to count until the exerciser stops. At the end of the exercise routine, the exerciser can see on the display a REPS count that indicates the number of times they were in the sit-up second position 12.

The exerciser can then power off the counter 10 or reset it for a separate count or a different exercise routine. Depending on the exercise, the exerciser can place the counter 10 on another part of his or her body or on an object or on the floor.

The embodiments of the present invention disclosed herein are understood to be merely exemplary of the invention, which may be embodied in various forms. Therefore the details disclosed herein are not to be interpreted as limiting, but merely as the basis for the claims and as basis for teaching one skilled in the art how to make and/or use the invention.

We claim:

1. An exercise repetitious motion counter, comprising:

a case;

a repetition counter display mounted within the case and visible through a first opening of the case;

a proximity sensor mounted within the case and extending through a second opening of the case to emit a reflectable light signal, the proximity sensor connected to the display to cause the display to show a repetition count when a portion of an exerciser's body comes into non-contact proximity to the proximity sensor as indicated by detection of the reflectable light signal reflected back to the proximity sensor; and a detection distance setting mounted within the case and extending through a third opening of the case, the detection distance setting being connected to the proximity sensor and variable to determine a distance proximity sensitivity range of the proximity sensor.

2. The counter of claim 1, wherein, the proximity sensor comprises a photoelectric sensor.

3. The counter of claim 1, further comprising a hinged easel attached at one end to a rear surface of the case.

4. The counter of claim 1, wherein, the easel comprises a slit sized to pass an exerciser's belt.

5. The counter of claim 1, wherein, the easel comprises a slit with a hook and eye strap passing through the slit.

6. The counter of claim 1, further comprising:

a clock circuit connected to the display; and a reset button connected to the proximity sensor and the clock circuit, the repetition counter display including a repetition display region and an elapsed time region.

7. The counter of claim 3, further comprising a battery compartment accessible through the rear of the case and concealed by the hinged easel.

8. The counter of claim 3, wherein the proximity sensor comprises a photoelectric sensor.

9. The counter of claim 1, wherein the proximity sensor comprises a reflected beam detector capable of sending a beam reflectable off a person to created a reflected beam and detecting the reflected beam.

10. A portable repetitious motion counter, comprising:

a case with plural surface openings;

a battery-powered repetition counter display visible through a first of the plural surface openings; and a photoelectric, reflected light sensing, proximity sensor extending through a second of the plural surface openings, the photoelectric proximity sensor connected to the display to cause the display to show a repetition count when a light beam emitted from the sensor is reflected back to the sensor to detect user proximity.

11. The counter of claim 10, further comprising a detection distance setting element mounted within the case and extending through a third of the plural openings of the case, the detection distance setting element being connected to the proximity sensor and variable to provide user-determination of a distance proximity sensitivity range of the proximity sensor.

12. The detector of claim 10, further comprising a belt-wearable element located on a rear surface of the case.

13. The counter of claim 10, further comprising a hinged easel attached at one end to a rear surface of the case.

14. The counter of claim 10, wherein, the easel comprises a slit running along a length of the easel.

15. The counter of claim 13, further comprising a battery compartment accessible through the rear surface of the case and concealed by the hinged easel.

16. An exercise repetitious motion counter, comprising:

a case;

a repetition counter display mounted within the case and visible through a first opening of the case;

a proximity sensor mounted within the case and extending through a second opening of the case, the proximity sensor emitting a reflectable light signal and determining an exerciser's movement by detecting the reflectable light signal reflected back to the proximity sensor, the proximity sensor connected to the display to cause the display to show a repetition count when the reflected light signal is detected indicating a portion of an exerciser's body comes into non-contact proximity to the proximity sensor.

17. The counter of claim 16, further comprising:

a detection distance setting mounted within the case and extending through a third opening of the case, the detection distance setting being connected to the proximity sensor and variable to determine a distance proximity sensitivity range of the proximity sensor based on reflected light originating from the proximity sensor.

18. The counter of claim 17, wherein, the proximity sensor comprises a photoelectric sensor.

19. The counter of claim 18, wherein, the counter is a stand-alone device, self-contained and battery powered.

20. The counter of claim 16, wherein, the proximity sensor is a self-calibrating, self-contained photoelectric sensor.

* * * * *